US007004441B1

(12) United States Patent
Rutland

(10) Patent No.: US 7,004,441 B1
(45) Date of Patent: Feb. 28, 2006

(54) CLIPPABLE PLASTIC NOTE

(76) Inventor: Michael D. Rutland, 2354/15 Santa Ana Ave., Costa Mesa, CA (US) 92627

( * ) Notice: Subject to any disclaimer, the term of this patent is extended or adjusted under 35 U.S.C. 154(b) by 0 days.

(21) Appl. No.: 10/888,385

(22) Filed: Jul. 8, 2004

Related U.S. Application Data

(60) Provisional application No. 60/489,640, filed on Jul. 24, 2003.

(51) Int. Cl.
*F16M 11/00* (2006.01)

(52) U.S. Cl. ..... 248/690; 40/634; 281/42

(58) Field of Classification Search ..... 248/690, 248/691, 231.81, 300, 301, 316.7; 24/563, 24/67.9; 281/42; D19/86; D8/371; 40/634
See application file for complete search history.

(56) References Cited

U.S. PATENT DOCUMENTS

| | | | | | |
|---|---|---|---|---|---|
| 1,430,641 | A | * | 10/1922 | Ginn | 40/663 |
| 2,669,047 | A | | 2/1954 | Rieger | |
| 2,847,774 | A | | 8/1958 | Brooks | |
| 3,067,534 | A | | 12/1962 | Paxton | |
| 3,264,698 | A | | 8/1966 | Wright | |
| 3,270,872 | A | | 9/1966 | Paxton | |
| 3,422,558 | A | | 1/1969 | Fee | |
| 3,775,882 | A | | 12/1973 | Wheeler | |
| 3,822,441 | A | | 7/1974 | Paxton | |
| 4,379,372 | A | | 4/1983 | Alexander et al. | |
| 4,414,716 | A | | 11/1983 | Stastney | |
| 4,492,048 | A | * | 1/1985 | Brewer | 40/634 |
| 4,519,178 | A | | 5/1985 | Crabb, Jr. | |
| 4,539,767 | A | * | 9/1985 | Jaffe | 40/316 |
| 4,760,624 | A | | 8/1988 | Fish | |
| 4,862,617 | A | | 9/1989 | Cooke, Jr. et al. | |
| 4,896,366 | A | | 1/1990 | Oxman | |
| 5,167,086 | A | | 12/1992 | Fast | |
| 5,495,645 | A | | 3/1996 | Suzuki et al. | |
| 5,573,825 | A | * | 11/1996 | Brewster | 428/43 |
| 5,617,656 | A | | 4/1997 | Ludlow et al. | |
| D379,830 | S | | 6/1997 | Wasylyk | |
| 5,669,327 | A | | 9/1997 | Beebe | |
| 5,697,177 | A | | 12/1997 | Ludlow et al. | |
| 5,913,619 | A | | 6/1999 | Lowe | |
| 6,085,453 | A | | 7/2000 | Volk | |

OTHER PUBLICATIONS

Page 287 of Office Depot catalog (undated).
Web page entitled "Key Tags" dated Oct. 10, 2003.

* cited by examiner

*Primary Examiner*—Ramon O Ramirez
(74) *Attorney, Agent, or Firm*—Knobbe, Martens, Olson & Bear, LLP

(57) ABSTRACT

A clippable note comprises a sheet of plastic material having a clipping portion and a writing portion. The clipping portion is semi-rigid and has an opening sized to receive a key ring on the like. The writing portion is also semi-rigid and has a textured surface which provides a matte-like finish. The textured surface permits the writing portion to be receptive to writing by a pencil.

13 Claims, 8 Drawing Sheets

CLIPPABLE PLASTIC NOTE

RELATED APPLICATION

This application claims the benefit of U.S. provisional application Ser. No. 60/489,640, filed Jul. 24, 2003, which is hereby incorporated herein by reference.

BACKGROUND OF THE INVENTION

1. Field of the Invention

The present invention relates generally to notes comprised of sheets of material which may be written upon by a writing instrument.

The most common form of note is a sheet of paper. Typically, a number of paper notes are joined together at one edge to form a note pad. While paper note pads are an effective medium for taking notes, they are usually not carried on the person, but instead are kept in the home or office. Further, paper notes are relatively fragile, easily torn, and generally unsuitable for carrying on the person.

Accordingly, there is a need in the art for a more durable type of note that can be conveniently carried on the person (for example, by clipping to a key ring), and is readily available for writing thereon with a writing instrument for providing reminders, recording telephone numbers, etc.

2. Summary of the Invention

According to one aspect of the invention, a clippable note comprises a sheet of plastic material, such as PVC. The sheet has a clipping portion and a writing portion. The clipping portion has an opening sized to receive an elongate member, such as a key ring. The opening is surrounded on all sides by said plastic material. The clipping portion additionally comprises a slit extending from an edge of the plastic sheet to the opening. In the preferred embodiment, the slit extends further from said edge than the opening extends from such edge. The slit curves around a periphery of said opening and into said opening so as to form a hook portion between the slit and the opening. The elongate member is received by the slit for a passage to said opening, thereby the plastic sheet is secured to the member. The clipping portion of the plastic sheet is semi-rigid. The writing portion has a textured surface which provides a matte-like finish that permits the writing portion to be receptive to writing by a pencil. Preferably, the writing portion is also semi-rigid.

Preferably, both the clipping portion and the writing portion have an approximate thickness of 15 to 30 mils, and more preferably 24–30 mils.

Another aspect of the invention comprises writing on the plastic sheet with a key. Such writing comprises depositing a metal from the key on the plastic sheet.

DETAILED DESCRIPTION OF THE PREFERRED EMBODIMENT

Figure 1:
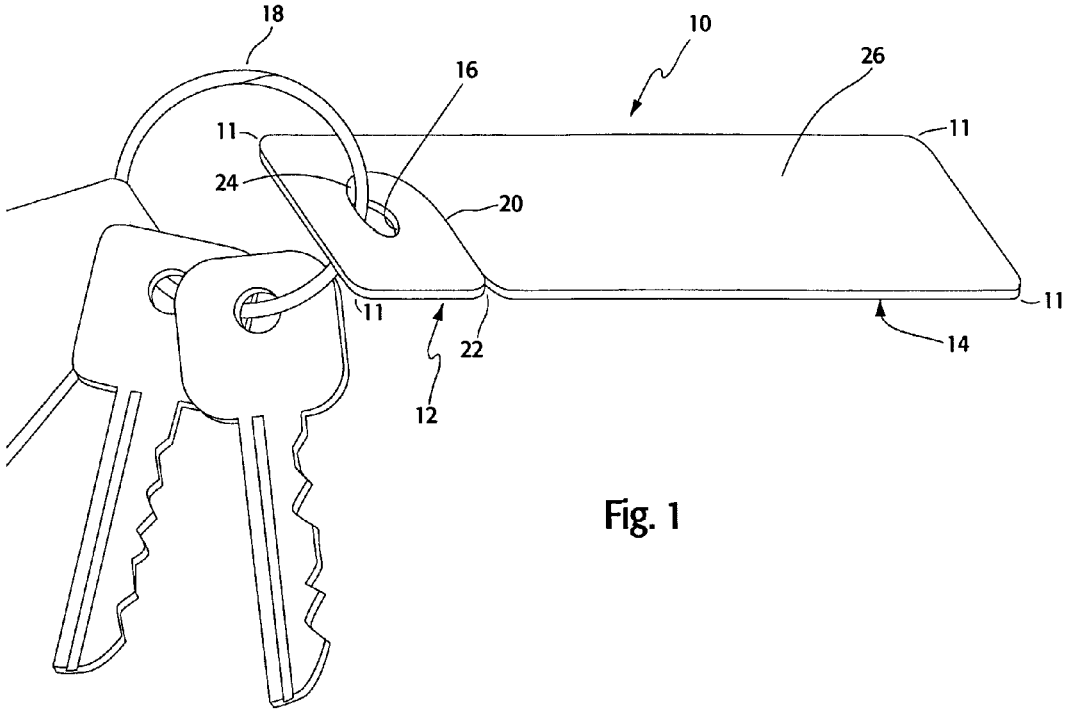
FIG. 1 is a perspective view of an embodiment of the invention showing a clippable note attached to a key ring.
Figure 2:
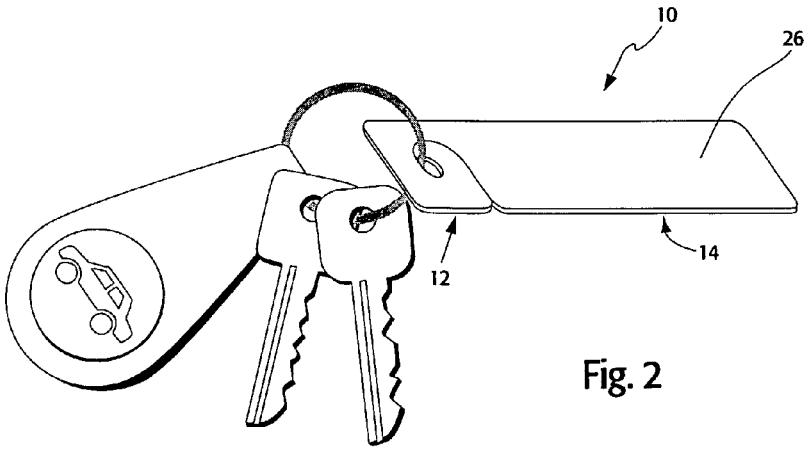
FIG. 2 is another view of the embodiment of FIG. 1.
Figure 3A:
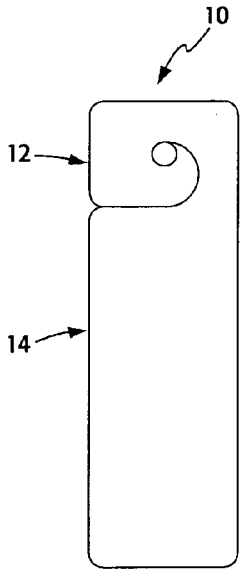
FIGS. 3A and 3B are plan and elevation views, respectively, of the embodiment of FIG. 1.
Figure 3B:
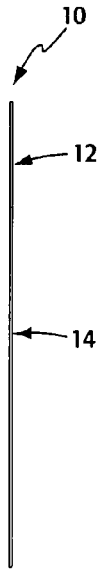
Figure 4:
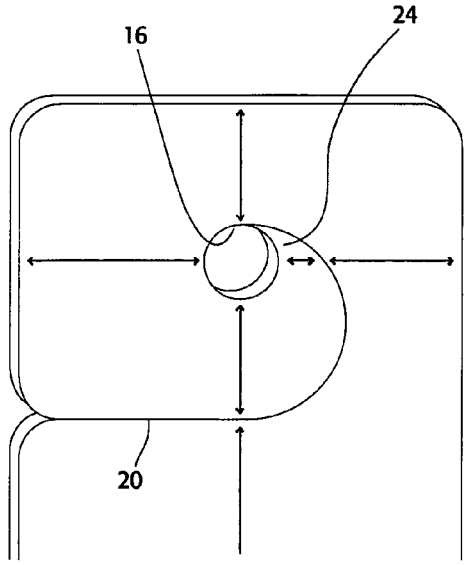
FIG. 4 is an enlarged view of the clipping portion of the embodiment of FIG. 1.
Figure 5:
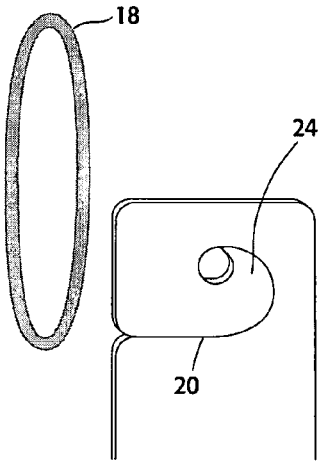
FIGS. 5, 6 and 7 are perspective views showing the sequence of attaching the embodiment of FIG. 1 to a ring, and showing how the plastic material bends to open the slit.
Figure 6:
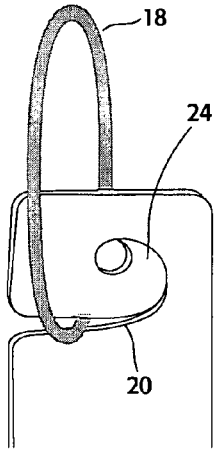
Figure 7:
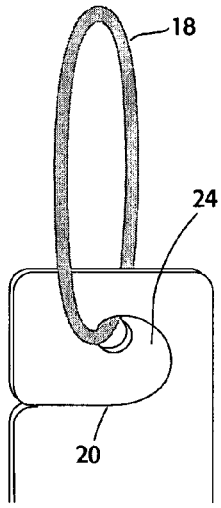
Figure 8:
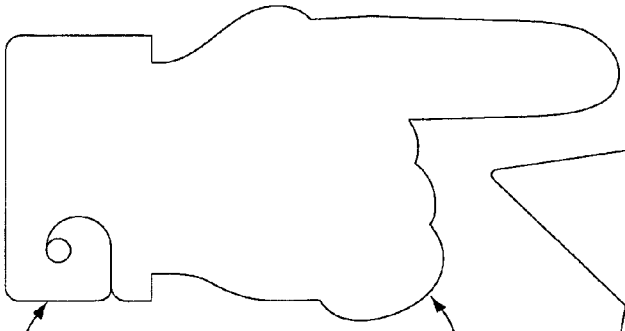
FIGS. 8, 9, 10, 11, 12, and 13 show various exemplary theme shapes for the clippable note of the present invention.
Figure 9:
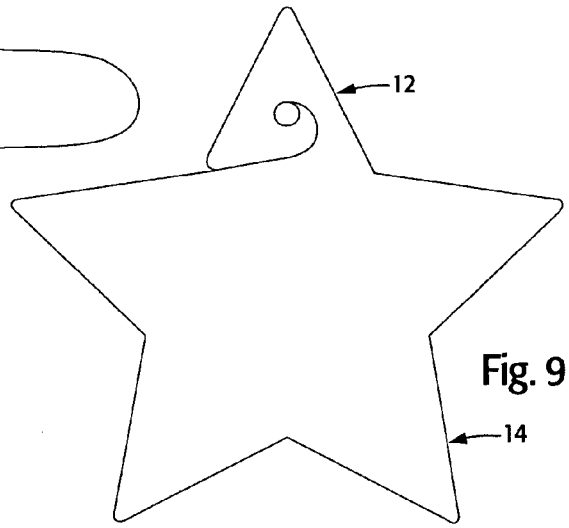
Figure 10:
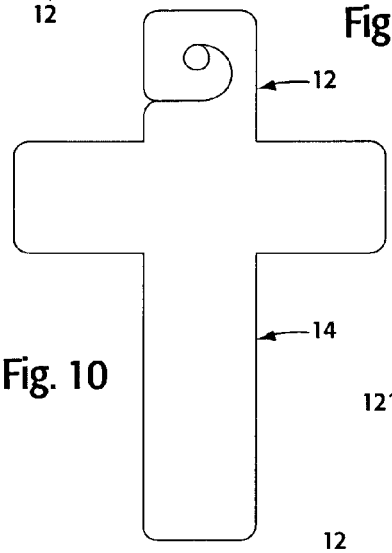
Figure 11:
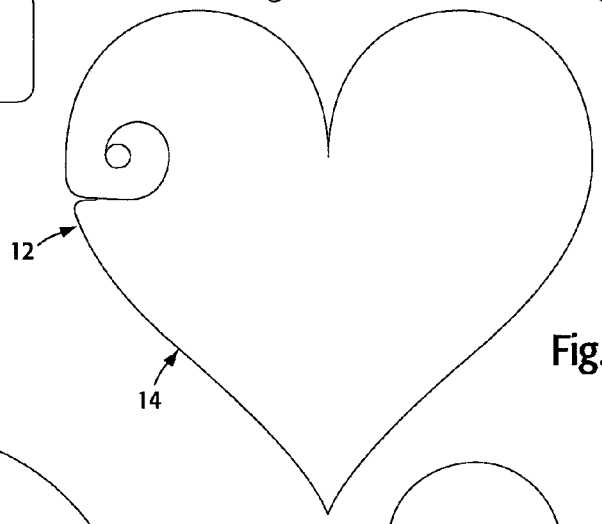
Figure 12:
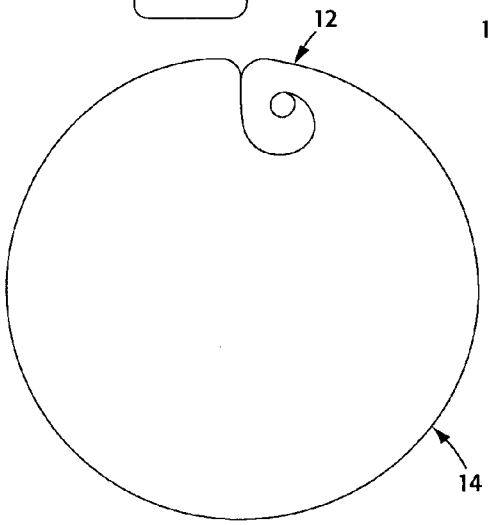
Figure 13:
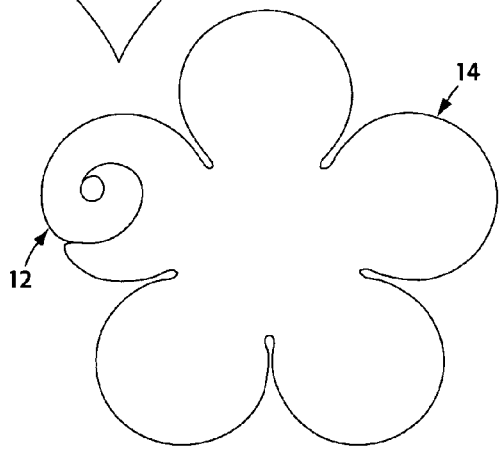
Figure 14:
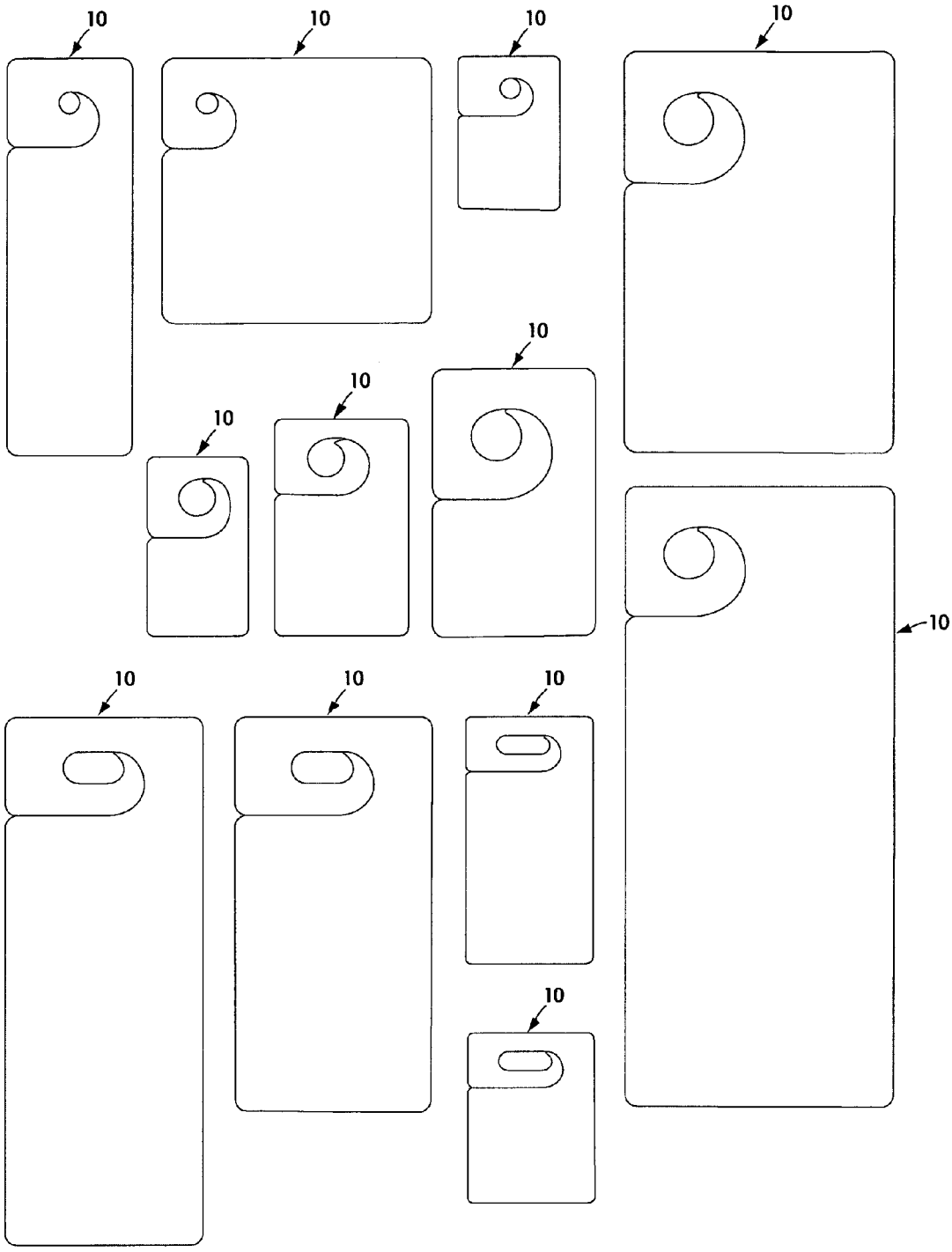
FIG. 14 shows various exemplary additional shapes and sizes for clippable notes.

As shown in FIGS. 1 to 4, a preferred embodiment of the clippable note 10 of the present invention comprises a flat, hard plastic sheet in the shape of a rectangle with rounded corners 11. The clippable note has a clipping portion 12 and a writing portion 14. The clipping portion 12 has an opening 16 sized to receive an elongate member 18 (such as, a key ring, notebook ring, purse strap, computer wires, or the like) and a slit 20 extending from a marginal edge of the clipping portion 12 to the opening 16. In the disclosed embodiment, the slit 20 has a mouth 22 at the marginal edge to facilitate introducing the clippable note 10 onto the key ring, etc. Preferably, the slit 20 extends further from such edge than does the opening, and curves around the periphery of the opening, so as to form a hook portion 24 between the slit and the opening. The opposing edges of the slit 20 are substantially touching, such that the slit 20 is normally closed. The clipping portion 12 is preferably semi-rigid, but sufficiently pliable to allow the opposing edges of the slit 20 to bend away from each other, thus causing the slit 20 to open during passage of the key ring 18 therethrough, as illustrated in FIGS. 5 and 6. However, the semi-rigid material is sufficiently rigid, such that when the key ring 18 reaches the opening 16, the hook portion 24 snaps back to its original position, thus closing the slit 20, as shown in FIG. 7. This configuration permits the clippable note to hang on the key ring 18 with the opening 16 surrounded on all sides by plastic material, and thus securely fastens the clippable note 10 to the key ring 18.

Although the clippable note 10 is securely retained on the ring 18 when hanging, it may be readily removed by the user. A relative twisting of the ring 18 and the note 10 will force the hook portion 24 outward, thereby opening the back end of the slit 20 to allow the ring 18 to be slid therethrough.

The writing portion 14 is integral with the clipping portion 12, and is preferably formed of the same material as the clipping portion 12. In particular, like the clipping portion, the writing portion 14 comprises a sheet of semi-rigid plastic, such as PVC, with an approximate thickness of 15 to 30 mils, and preferably 24 to 30 mils. The hard plastic material can be cut, stamped or die-cut to provide the individual shapes required per each product/usage. The surfaces 26 of the material (on both sides of the sheet) have a microscopic texture, courser or finer based on the various application usage, producing a matte-like finish. This texture is applied during the manufacturing. The trade industry calls this calendering. Alternatively, the textured sheet may be formed by extrusion. The roughness of the texture may be adjusted by controlling the rate of cooling of the extruded PVC (the faster the cooling, the greater the roughness). The matte-like finish partly visible to our eye, allows the receiving of ink or pencil. Preferably, the ink or pencil can be erased to permit the writing portion to be reused. The rigid material chosen can also be coated on the surface of the writing portion with a liquid material, such as ink, varnish, or paint that when applied correctly leaves the surface with a receptive ability to write on with a pencil, pen or various types of marker pens.

Another advantageous property of the textured writing portion is that common brass and aluminum keys can be used to write on it. The texture of the writing surfaces 26 pulls microscopic metal fragments from the key and deposits them thereon, so as to provide legible writing. This property allows notes to be made when no conventional writing instrument is available.

Figure 15:
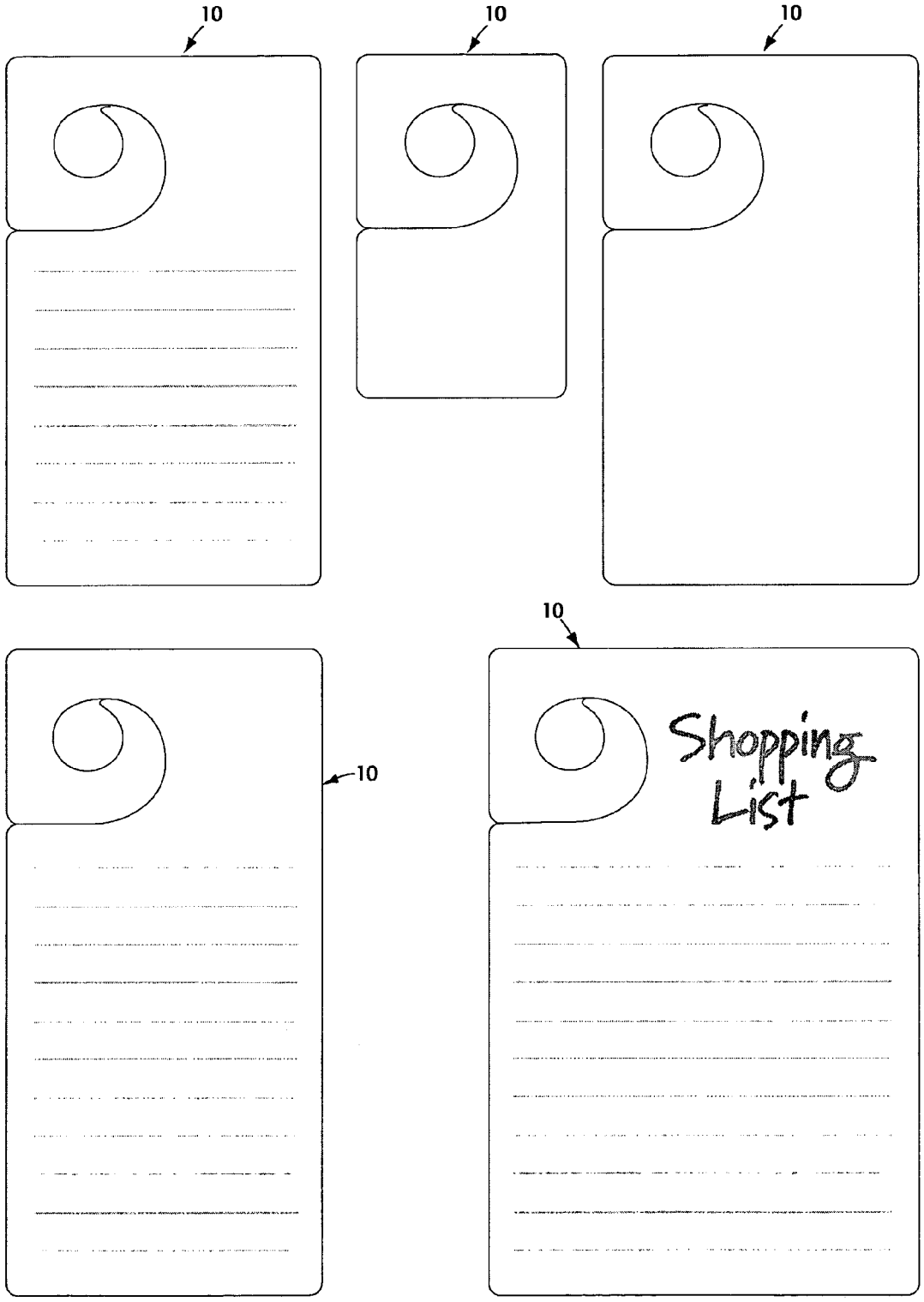
FIG. 15 shows various exemplary pre-printed material, such as lines.

It will be appreciated that the writing portion 14 may vary in size, shape and color, per individual application or purpose. As shown in FIGS. 8 to 14, the clippable note 10 can be simple as a rectangle, square, circle or complex as animal shapes, holiday shapes, or other miscellaneous theme shapes. Some pre-printed imprints may be added, such as the lines shown in FIG. 15, to enhance the functionality of the clippable note 10.

An addition to the clippable note 10 is the application of a thin adhesive magnet that can be applied to one side to further enhance the usage in the application of sticking magnetically to metal in the car or on the refrigerator. The clippable note 10 can also be adhered with double-sided foam tape, and cut to fit the side of a carpenter's tape measure, thus allowing the notes (measurements) to be written in pencil and erased with ease with a moistened finger.

Figure 16:
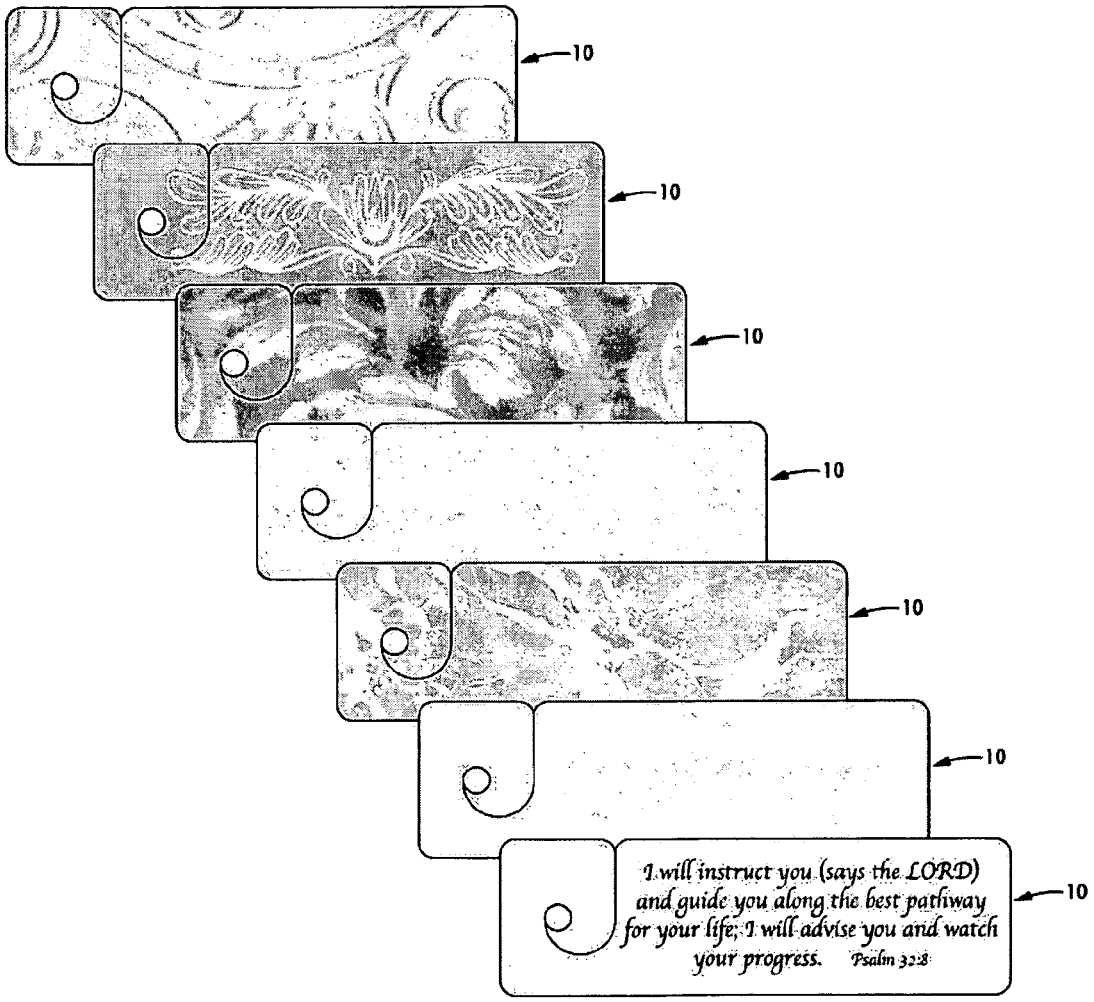
FIG. 16 shows various exemplary clippable notes depicting background wallpaper, logo, or messages, which may be written over by a writing instrument.

Another application for the clippable note 10 would be after market capabilities. The advertising specialty market can imprint on the clippable note a company's logo or other art for the purpose of promoting a company or product. Additionally, the clippable notes 10 may be decorated with wallpaper or messages, such as bible verses, as shown in FIG. 16.

Figure 20:
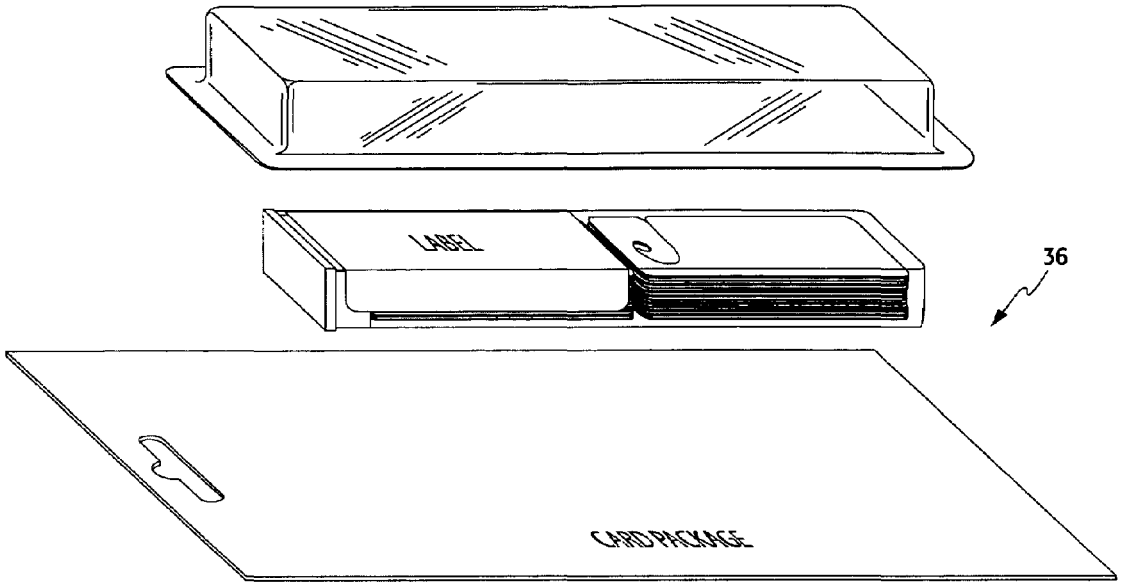
FIG. 20 shows a blister package which contains the two-stack container.

A clippable note storage container 30,32 for holding a stack 34 of clippable notes is comprised of a clear poly tube, cap and label, as shown in FIGS. 17–20. A short version 30 is approximately 3½ inches in length, while a tall version 32 is approximately 7 inches in length. The advantage of the tall container is that it can be visible when placed in a pen and pencil holder standing up. The advantage of the small container is that it is small enough that it can be placed in a purse, pocket or desk drawer requiring little space. Either version 30, 32 may be packaged in a blister pack 36, as shown in FIG. 20. The tube and the card may be marketed together as a point of sale item. As a lower cost alternative to the larger card packaging, is a hook 38 made of the same clear poly material as the tube 32 can be affixed or glued to the top back side of the tube allowing point of sale to require less shelf space.

What is claimed is:

1. An apparatus, comprising:

a sheet comprised of plastic material, said sheet having a clipping portion and a writing portion, said clipping portion having an opening sized to receive an elongate member, said opening surrounded on all sides by said plastic material, said clipping portion additionally comprising a slit extending from an edge of the plastic sheet to said opening, the slit extending at least half way around a circumference of said opening said clipping portion formed so that said elongate member is received by said slit for passage to said opening, whereby the plastic sheet is secured to said member, said clipping portion of the plastic sheet being semi-rigid, such that edges of the slit bend away from each other during said passage of the elongate member, the rigidity of said semi-rigid sheet causing said edges to move back to their original position when the elongate member reaches said opening to securely fasten the sheet to the elongate member, said writing portion also being semi-rigid and having a textured surface which provides a matte finish that permits the writing portion to be receptive to writing by a pencil.

2. The apparatus of claim 1, wherein said clipping portion has an approximate thickness of 24 to 30 mils.

3. The apparatus of claim 2, wherein said slit extends further from said edge than said opening extends from said edge.

4. The apparatus of claim 3, wherein said slit curves around a periphery of said opening and into said opening so as to form a hook portion between the slit and the opening.

5. The apparatus of claim 4, wherein said slit forms a mouth at said edge for receiving said elongate member.

6. The apparatus of claim 1, wherein the writing portion contains indicia selected from the group consisting of wallpaper, a logo, a bible verse, or other message.

7. The apparatus of claim 1, wherein the clipping portion and writing portion are formed of the same plastic material.

8. The apparatus of claim 1, wherein said plastic material comprises PVC.

9. The apparatus of claim 1, wherein the pencil writing to which said textured surface is receptive is erasable with a moistened finger.

10. The apparatus of claim 1, wherein said sheet is elongate and said opening is near one end of the elongate sheet.

11. The apparatus of claim 1, wherein said opening is sized to receive an elongate member comprising a key ring.

12. A method comprising:

providing a sheet comprised of plastic material, said sheet having a clipping portion and a writing portion, said clipping portion having an opening sized to receive an elongate member, said opening surrounded on all sides by said plastic material, said clipping portion additionally comprising a slit extending from an edge of the plastic sheet to said opening and extending at least half way around a circumference of said opening, said clipping portion formed so that said elongate member is received by said slit for passage to said opening, whereby the plastic sheet is secured to said member, said writing portion of the plastic sheet being semi-rigid, and having a textured surface which provides a matte finish that permits the writing portion to be receptive to writing by a pencil;

placing an elongate member into said opening; and using the rigidity of said semi-rigid plastic sheet to maintain said slit in a closed condition which securely fastens the sheet to the elongate member.

13. The method according to claim 12, wherein a key ring extends through the opening.

* * * * *

UNITED STATES PATENT AND TRADEMARK OFFICE

CERTIFICATE OF CORRECTION

PATENT NO. : 7,004,441 B1
APPLICATION NO. : 10/888385
DATED : February 28, 2006
INVENTOR(S) : Michael D. Rutland It is certified that error appears in the above-identified patent and that said Letters Patent is hereby corrected as shown below:

Title Page 1, Column 2, in Primary Examiner, please delete "Ramon O Ramirez" and insert --Ramon O. Ramirez--

In Column 1, Line 40, after "for", please delete "a"

In Column 1, Line 40, please delete "thereby" and insert --whereby--

Figure 19:
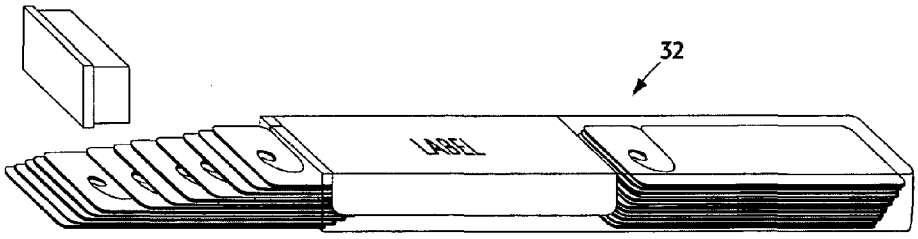
Figure 18:
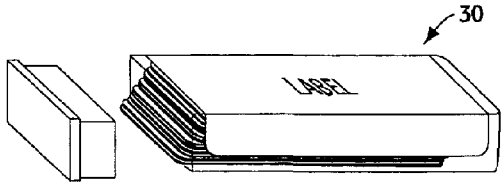
FIG. 18 shows a container for the stack of clippable notes.
Figure 17:
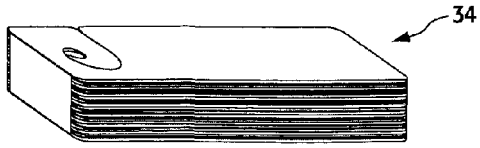
FIG. 17 shows a stack of clippable notes.
Figure 21:
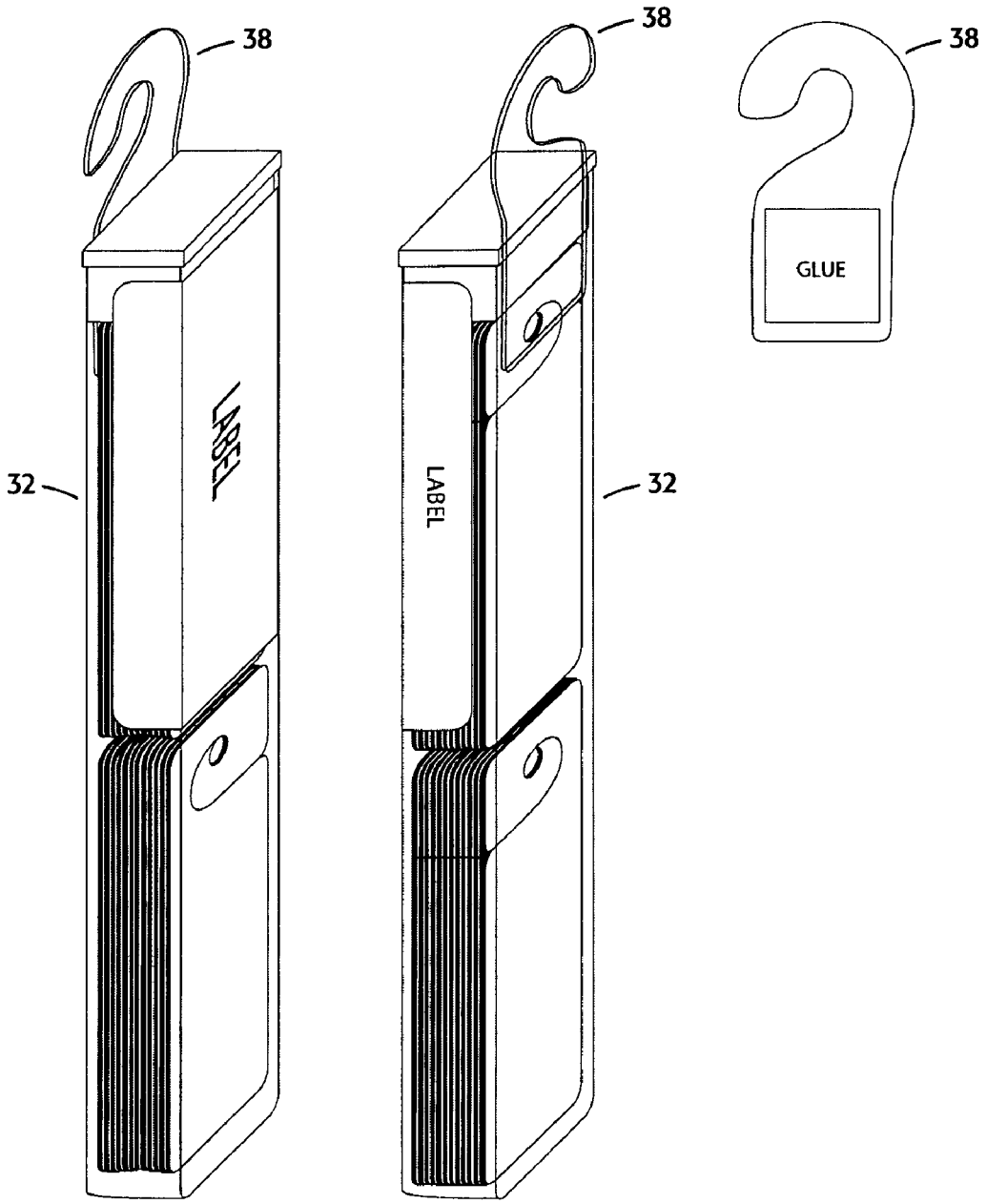
FIG. 21 shows a two-stack container having a hook for a point of purchase display.

In Column 2, between Lines 9 and 10, Below "FIG. 18 shows…..clippable notes.", please insert --FIG. 19 shows a container for two stacks of clippable notes.--

Signed and Sealed this

Twelfth Day of December, 2006

JON W. DUDAS
*Director of the United States Patent and Trademark Office*